US007901063B2

(12) United States Patent
Wouters et al.

(10) Patent No.: US 7,901,063 B2
(45) Date of Patent: Mar. 8, 2011

(54) INK REJUVENATION SYSTEM FOR INKJET PRINTING

(75) Inventors: Paul Wouters, O.L.V. Waver (BE); Bart Verhoest, Niel (BE); Werner Van de Wynckel, Mortsel (BE); Robert Janssens, Geel (BE); Erwin Kempeneers, Eke-Nazareth (BE)

(73) Assignee: Agfa Graphics NV, Mortsel (BE)

( * ) Notice: Subject to any disclaimer, the term of this patent is extended or adjusted under 35 U.S.C. 154(b) by 644 days.

(21) Appl. No.: 11/792,792

(22) PCT Filed: Dec. 15, 2005

(86) PCT No.: PCT/EP2005/056816

§ 371 (c)(1),
(2), (4) Date: Feb. 11, 2008

(87) PCT Pub. No.: WO2006/064040

PCT Pub. Date: Jun. 22, 2006

(65) Prior Publication Data

US 2008/0297577 A1 Dec. 4, 2008

Related U.S. Application Data

(60) Provisional application No. 60/648,020, filed on Mar. 4, 2005.

(30) Foreign Application Priority Data

Dec. 17, 2004 (EP) ..... 04106662

(51) Int. Cl.
*B41J 2/175* (2006.01)

(52) U.S. Cl. ..... 347/89; 347/92; 347/85

(58) Field of Classification Search ..... 347/84, 347/85, 89, 92
See application file for complete search history.

(56) References Cited

U.S. PATENT DOCUMENTS

| | | | | |
|---|---|---|---|---|
| 4,929,963 | A | 5/1990 | Balazar | |
| 5,771,052 | A | 6/1998 | Hine | |
| 6,007,193 | A * | 12/1999 | Kashimura et al. | 347/92 |
| 6,283,585 | B1 * | 9/2001 | Ikkatai et al. | 347/85 |
| 6,371,607 | B2 * | 4/2002 | Wouters et al. | 347/89 |
| 6,443,560 | B1 * | 9/2002 | Okano et al. | 347/55 |
| 6,485,137 | B2 | 11/2002 | Karlinski | |

FOREIGN PATENT DOCUMENTS

| | | | |
|---|---|---|---|
| EP | 0714779 | A2 | 6/1996 |
| EP | 0714779 | A3 | 6/1996 |
| EP | 0714779 | B1 | 6/1996 |
| EP | 1120257 | A2 | 8/2001 |
| EP | 1120257 | A3 | 8/2001 |
| EP | 1120257 | B1 | 8/2001 |
| EP | 1142713 | A2 | 10/2001 |

* cited by examiner

*Primary Examiner* — Anh T. N. Vo
(74) *Attorney, Agent, or Firm* — Keating & Bennett, LLP

(57) ABSTRACT

An ink circulation system for use in an inkjet printing apparatus includes an inkjet printhead, an ink supply path for supplying an ink to the inkjet printhead and an ink return path for returning ink not used for printing from the inkjet printhead. The ink return path is coupled to the ink supply path for replenishing the ink supply path with the ink returned from the printhead. The coupling establishes an ink circulation circuit. The ink circulation circuit can be replenished with fresh ink from a main tank, as ink is withdrawn by the printhead for printing. In the circulation system an active through-flow ink degassing unit is provided to control the dissolved gas level of the ink in the ink circulation system.

13 Claims, 9 Drawing Sheets

INK REJUVENATION SYSTEM FOR INKJET PRINTING

This application is a national stage filing under 35 USC §371 of PCT application no. PCT/EP2005/056816 filed Dec. 15, 2005 which claims priority to U.S. provisional application No. 60/648,020 filed Mar. 4, 2005 and EP application no. 04106662.2 filed Dec. 17, 2004.

FIELD OF THE INVENTION

The present invention relates to droplet deposition apparatus and especially to inkjet printing apparatus. More specifically the invention is related to ink delivery systems for inkjet printers.

BACKGROUND OF THE INVENTION

Printers are used to print output from computers or similar type of devices that generate information, onto a recording medium such as paper. Commonly available types of printers include impact printers, laser printers and inkjet printers. The term "inkjet" covers a variety of physical processes and hardware but basically these printers transfer ink from an ink supply to the recording medium in a pattern of fine ink drops. Inkjet printheads produce drops either continuously or on demand. "Continuously" means that a continuous stream of ink drops is created, e.g. by pressurizing the ink supply. "On demand" differs from "continuous" in that ink drops are only ejected from a printhead by manipulation of a physical process to momentarily overcome surface tension forces that keep the ink in the printhead. The ink is held in a nozzle, forming a meniscus. The ink remains in place unless some other force overcomes the surface tension forces that are inherent in the liquid. The most common practice is to suddenly raise the pressure on the ink, ejecting it from the nozzle. One category of drop-on-demand inkjet printheads uses the physical phenomenon of electrostriction, a change in transducer dimension in response to an applied electric field. Electrostriction is strongest in piezoelectric materials and hence these printheads are referred to as piezoelectric printheads. The very small dimensional change of piezoelectric material is harnessed over a large area to generate a volume change that is large enough to squeeze out a drop of ink from a small chamber. A piezoelectric printhead includes a multitude of small ink chambers, arranged in an array, each having an individual nozzle and a percentage of transformable wall area to create the volume changes required to eject an ink drop from the nozzle, in according with electrostriction principles.

The present invention deals with the way ink is supplied to the ink chambers, the conditioning of the ink and the impact of ink conditioning on the operation of an inkjet printhead.

Entrapped Air in the Ink Chambers

It is known that the presence of air bubbles in the ink chamber of a piezoelectric printhead often causes operational failure of the printhead. If air is present in the ink chamber, intended pressure changes resulting from piezoelectric deformation of part of the ink chamber walls will be absorbed by the air, leaving the ink pressure unaffected. The surface tension force of the ink in the nozzle maintains the meniscus and no drops will be ejected from the ink chamber. At the frequencies at which piezoelectric transducers in priezoelectric printhead are operated, i.e. in the khz to Mhz range, not only air bubbles but also dissolved air in the ink can cause operation failure as described above. In the prior art, concepts have been disclosed to avoid air bubbles in the ink chamber by creating an air trap upstream the ink chamber, i.e. prior to the ink entering the ink chamber. Solutions have been proposed in EP-A-0 714 779 and U.S. Pat. No. 4,929,963, both herein incorporated by reference in their entirety for background information only, in the form of air buffers or gas separators that allow air bubbles to rise and evacuate from the ink in an intermediate tank before the ink is supplied to the printhead. In U.S. Pat. No. 5,771,052, herein incorporated by reference in its entirety for background information only, a deaerator tube is disclosed as an internal part of an inkjet printhead. The deaerator tube is an air-permeable, ink-impermeable tubular membrane allowing air to be withdrawn from the ink, through the membrane, via a vacuum source.

Back-Pressure Control at the Nozzle in Fast Scanning Applications

A second point of attention in ink supply systems is the pressure at the nozzle, which is critical to a well-tuned and good operating printhead. Inkjet printheads operate best at a slightly negative nozzle pressure or back pressure. In practice this is often achieved by maintaining a height difference between the free ink surface in a vented ink supply tank and the meniscus in the nozzle. That is, the free ink surface in the vented supply tank is maintained gravimetrically a couple of centimeters below the level of the meniscus in the nozzle. This height difference established a hydrostatic pressure difference to control the back pressure at the nozzle. In reciprocating printhead configurations the ink supply tank is located off axis, i.e. not scanning, because otherwise the lowered position of ink supply tank versus the printhead would interfere with the printing medium transport path. Flexible tubing is used to connect the off axis ink supply tank with the on axis printhead, as disclosed in for example U.S. Pat. No. 4,929,963. During acceleration and deceleration of the printhead, pressure waves are created in the tubes that may significantly disturb the pressure balance at the meniscus and may lead to weeping of the nozzle in the case of a decrease in negative pressure, or breaking of the meniscus in the case of an increase in negative pressure and taking air into the ink channel. Many approaches have been proposed to control the back pressure in reciprocating printhead applications. A back pressure regulation mechanisms in the form of pressure buffers or dampers mounted together with the printhead on the reciprocating carriage are disclosed in EP-A-1 120 257 and U.S. Pat. No. 6,485,137, both herein incorporated by reference in their entirety for background information only. For accelerations and decelerations of the carriage above 1G the response time of these devices is insufficient. In EP-A-1 142 713, herein incorporated by reference in its entirety for background information only, a vented subtank is used. The subtank serves as a local ink reservoir near the printhead and is being filled intermittently from a main tank located off axis. The solution provides a better control of the nozzle back pressure by maintaining a local hydrostatic pressure difference between the free ink surface of the vented subtank and the meniscus.

Degradation with Time of Ink Properties in Printheads (Especially for Inactive Nozzles Over a Longer Period of Time)

Although inkjet ink properties can be well controlled at manufacture and maintained at a reasonable level during transport and storage, some ink properties may degrade when the ink is used in an ink system or maintained in the printhead. For instance, inkjet inks containing VOC's (volatile organic compounds) often suffer from evaporation of some VOC's at the ink meniscus in the nozzle. The viscosity of the ink will change locally in the nozzle, having a negative effect on its jetting properties and potentially leading to a nozzle fall out. The time it takes for an ink to degrade in a way that it leads to a nozzle failure, is often referred to as its latency period. Latency problems often are prevented or recovered by regular maintenance of the nozzles, e.g. by purging the nozzle so that 'fresh' ink enters the nozzle. Next to these problems, it has been found that if the retention time of ink in an ink supply system is too long, e.g. during production breaks or overnight, effects like settling of dispersions, auto-curing, etc. may occur. In many cases, reliable operation of an inkjet printer after a production break or production shutdown is only achieved after an extensive startup procedure, including purging of a significant amount of degraded ink retained in the whole or part of the ink supply system to assure that the ink in the ink chambers of the printhead is of good quality and will perform reliably in the printhead. Often these amounts of purged ink are not reusable within the printer setup.

For production type inkjet printing equipment, where high printing speeds and reliability are of the outmost importance, the conditioning of the ink is critical. The solutions proposed in the prior art only partially solve some of the problems described above. Therefore it is an object of the present invention to provide an ink system, incorporated in an inkjet printer, that brings the ink in optimal condition immediately after startup and keeps it in optimal condition during printing.

SUMMARY OF THE INVENTION

It is an object of the invention to provide an ink system for inkjet printers that provides optimally conditioned and continuously rejuvenated ink to the inkjet printheads. In one embodiment of the inventions, this object is realized by active degassing of the ink in a continuous ink circulation system.

Specific features of preferred embodiments of the invention are set out in the claims.

Further advantages and embodiments of the present invention will become apparent from the following description and drawings.

DETAILED DESCRIPTION OF THE INVENTION

Figure 1:
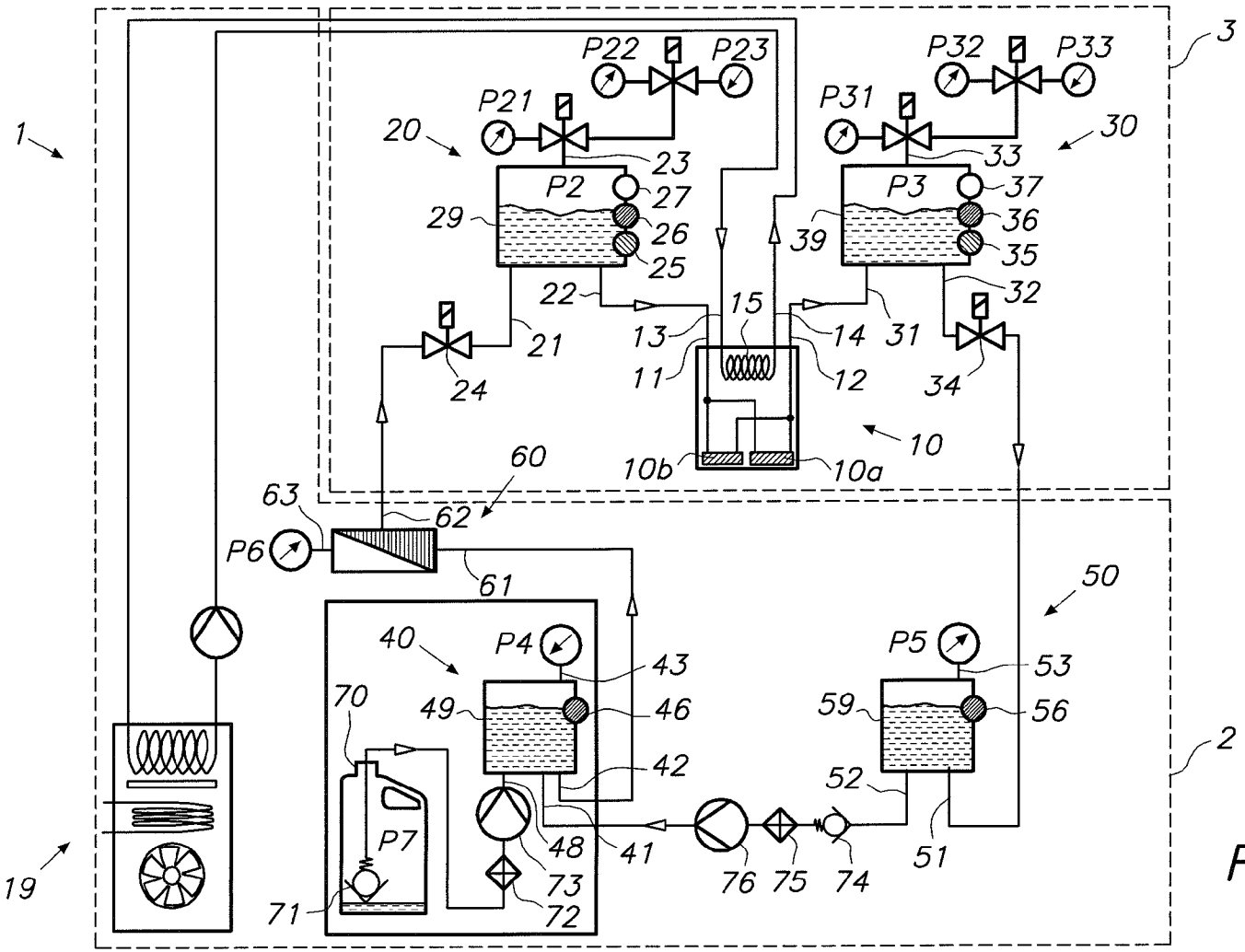
FIG. 1 shows a schematic view of a first embodiment of an ink system according to the present invention.

The applicability of the present invention is wide-ranging.

Applicability Regarding Printer Configuration

The invention may be applied in printers with reciprocating printhead configurations known from the SOHO market, i.e. the small-office and home inkjet printers, and the wide format market, e.g. for point-of-sale applications, advertising, etc. In these kinds of printing apparatus, the inkjet printheads move in a first direction, the fast scan direction, across the recording medium, while printing ink drops onto the recording medium. In between two fast scan operations, the recording medium is forwarded in a second direction, the slow scan direction perpendicular to the fast scan direction, so as to present an unprinted part of the recording medium underneath the printhead's fast scan print swath trajectory. Multiple printheads may be assembled onto a single carriage moving back and forth along the fast scan direction. Numerous printer configurations and printing methods including reciprocating printheads have been described and are commercially available.

As opposed to reciprocating printhead configurations, fixed array configurations are also known. In the fixed array setup, printheads are stationary and only the recording medium is moved in a feeding direction while the printheads are printing. The stationary printheads may either print a specific swath of the recording medium, e.g. for variable data printing of name and address labels within a dedicated area on preprinted forms, or the stationary printheads may be arranged in an array to print page wide, e.g. for digital printing of packaging material or labels on a single pass digital press.

Except for the SOHO printing apparatus, almost all inkjet printing apparatus use an ink system that delivers ink from a replaceable ink supply tank to the inkjet printheads. The ink is ejected as individual drops from the printhead nozzles, according to a predefined pattern. Depending on the application, this pattern may represent an image in a poster printing application, a conductive structure in an application for printed electronics, glue tracks in a bonding application, etc. The present invention can be implemented on any of these inkjet printing apparatus.

Applicability Regarding Printhead Technology

Inkjet printing is a generic term for a number of different printing technologies that all eject drops of ink from a printhead nozzle in the direction of a recording medium. The most important inkjet printhead technologies today include continuous inkjet, drop-on-demand thermal inkjet and drop-on-demand piezoelectric inkjet. Within the drop-on-demand inkjet technology we may further distinguish between end-shooter type printheads, side-shooter type printheads and through-flow type printheads, depending on their design. End-shooter printheads are characterized by having the nozzles at the end of the ink chambers, while side-shooter printheads are characterized by having their nozzles at a side of the ink chambers. End-shooter and side-shooter printheads require one ink connection for providing the ink via an ink manifold to a plurality of individual ink chambers each having actuating means for ejecting a drop of ink through their nozzle. The ink supplied to the printhead is retained in the printhead until it is ejected from a nozzle. Through-flow printheads on the other hand are characterized by having a continuous flow of ink through the ink chambers, i.e. ink flows via an ink inlet into a supply manifold, through a plurality of individual ink chambers, ending into a collector manifold from where the ink leaves the printhead via an ink outlet. Only a small part of the ink volume that continuously flows through the ink chambers is used for ejecting ink drops from the nozzle, e.g. less than 10%. Hybrid printhead designs are also known, e.g. end-shooter type printheads where the ink manifold has an ink inlet and an ink outlet. Here the ink contained in the end-shooter ink chambers is retained in the printhead until used; the ink in the ink manifold may be refreshed continuously. The present invention is independent of inkjet printhead technology or printhead type. Although the embodiments described in detail in the following sections of the detailed description will deal mainly with hybrid type piezoelectric printheads, i.e an end-shooter with through-flow characteristics, the invention is likewise applicable to other type of printheads, as will become evident from the further description.

Applicability Regarding Inkjet Inks

'Inks' used for inkjet printing processes are no longer limited to colored printing material for image reproduction, but include nowadays also structuring materials for printing of OLED displays, electronic conducting materials for printed RFID tags, adhesives materials, etc. Especially piezoelectric inkjet technology is often used for jetting a variety of liquid materials other than traditional printing inks because the physics behind piezoelectric inkjet, i.e. electrostriction, does not put constraints on the chemical composition of the liquid material to be jetted. This is not the case for thermal inkjet technology requiring a local 'evaporation' of the ink, or continuous inkjet technology requiring 'electrostatic charging' of the ink drops.

From a chemical composition point of view, inkjet inks often are categorized in families based upon the carrier material, e.g. water, used to carry the functional material, e.g. pigments. Examples of ink families based on the carrier used include, water-based inks, solvent inks, oil-based inks, UV or EB curable inks, hot melt inks, and recently introduced eco-solvent and bio inks both aiming at environment friendly usage.

From the discussion in the background of the invention, it is known that performance and reliability of inkjet printing systems increase with the use of degassed inks because undesired air bubbles that develop in the ink chambers seriously disturb the drop generation process and even may result in failure of the ink ejection process.

Therefore it is preferred to use degassed ink in the printing process. Although the present invention will be described in more detail with reference to a UV curable ink, the invention is not limited to UV curable inks but can also be used to improve the performance of other types of ink.

From the background of the invention, it is also known that some ink dispersions settle easily when retained too long without stirring. A typical example is a pigmented ink using Titanium Dioxide as a white pigment. These inks require a continuous circulation to keep the ink dispersion fit for jetting purposes.

FIRST EMBODIMENT

Description

In FIG. 1 a schematic diagram is shown of an ink system 1 embodying the invention. The ink system 1 may be divided into an off-axis ink system 2 and a carriage ink system 3. The split in two separate parts may be advantageous in inkjet printers with reciprocating printheads. Here the carriage ink system 3 may be positioned together with the printheads onto a single reciprocating carriage, and the off-axis ink system 2 may be stationary with respect to the reciprocating operation of the printheads. In fixed array printhead configurations like in single pass digital presses, both parts may be stationary. The carriage ink system 3 includes an inkjet printhead having two arrays of nozzles 10*a* and 10*b*, both arrays may be interlaced so as to provide a print resolution which is double the intrinsic resolution of the individual arrays of nozzles. The printhead has as ink inlet 11 for receiving ink from a supply subtank 20, and an ink outlet 12 for returning ink to a return subtank 30.

The printhead may have conditioning means, generally indicated with reference number 15 in FIG. 1, e.g. heating elements for operating the ink at elevated temperature or a heat sink for cooling the electronics and other heat dissipating parts. The conditioning means 15 has its own electric or fluid connections to a separate conditioning circuit generally indicated with 19 in FIG. 1. E.g. the printhead 10 may be connected to a fluid circulation system wherein a conditioning fluid at elevated temperature is circulated to (pre-)heat the printhead to its operating temperature. The fluid circulation system may pass other components of the ink system that can benefit from (pre-)heating, e.g. the supply subtank 20 where the ink can be (pre-)heated before being supplied to the printhead 10. (Pre-)heating of the ink in the supply subtank 20 has the advantage of reducing the solvability of gas in the ink, a topic to be discussed later when active degassing is explained. One practical example may be that the fluid circulation system includes extrusion parts through which a conditioning fluid at elevated temperature flows and onto which the supply subtank 20 may be mounted so as to create a heat-exchange interface between the conditioning fluid and the supply subtank.

Figure 2C:
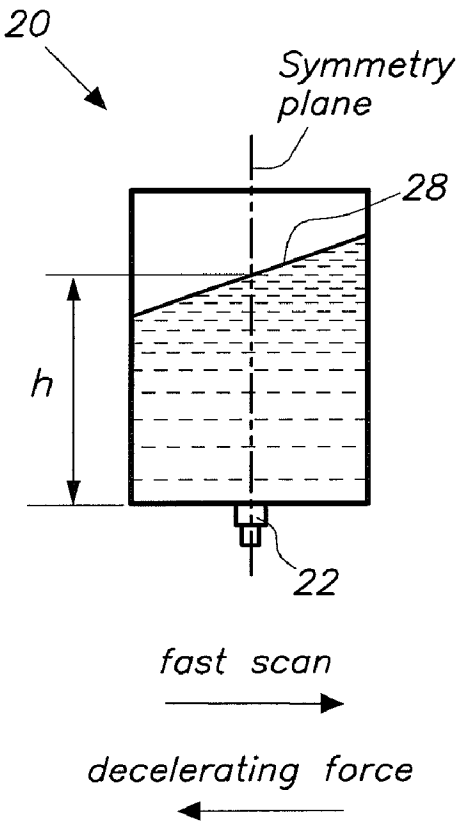
FIGS. 2A, 2B and 2C show the free ink surface in an accelerating or decelerating subtank and the preferred position of ink in- and outlets from the subtank.
Figure 2B:
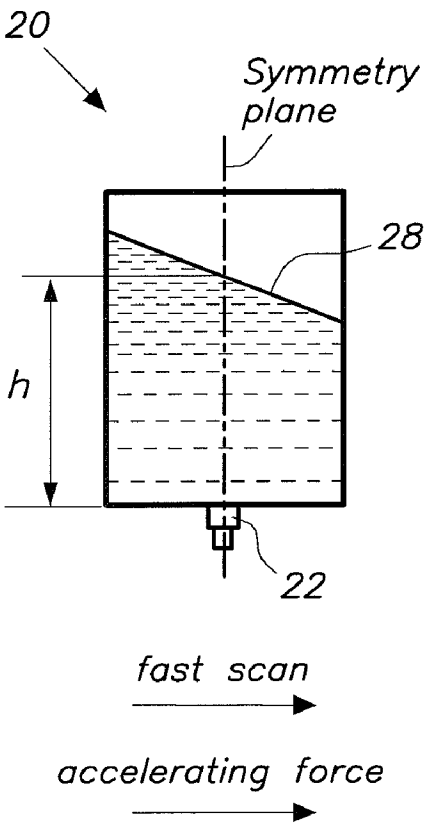
Figure 2A:
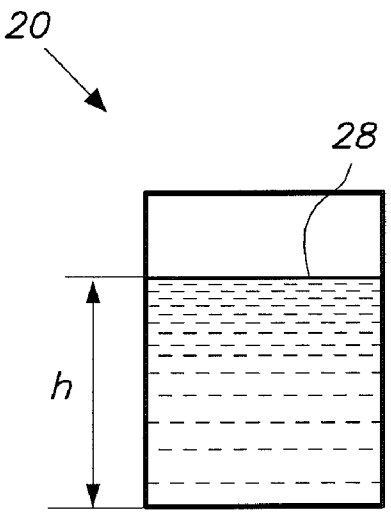

The supply subtank 20 includes a closed container 29 for containing ink, an ink entry 21 for replenishing the ink in the container, an is ink exit 22 for feeding ink to the printhead, a pressure connection 23 for applying a pressure to the closed container and one or more ink level sensors 25, 26, 27 for monitoring the free ink surface in the container 29. These sensors may output an analogue signal, e.g. representing a continuous level measurement, or a digital signal, e.g. in case of a level switch. In the further description of the invention both sensor types, or combinations of sensor types, may be used. Referring to FIG. 1, the three ink level sensors may be configured as a minimum level sensor 25 used for starting the ink replenishing process combined with a maximum level sensor 27 used for stopping the replenishing process; there may be only one operating level sensor 26 with a hardware or software hysteresis range for creating a similar functionality; there may be a combination where a single operating level sensor 26 is used and the level sensors 25 and 27 are use as underflow and overflow alarm indications, or still another combination. In general, the target of the sensors is to monitor the ink level in the container 29 and trigger the starting and stopping of the ink replenishment process, as well as signaling alarm conditions like overflow or underflow of the ink level in the subtank. Multiple embodiments of ink supply subtanks have been described in EP-A-1 142 713, all of which can be used with the present invention. The return subtank 30 may be a "copy" of the supply subtank 20, having similar features for realizing equivalent functions, e.g. the ink entry 31 receives ink from the printhead, the ink exit 32 drains ink from the return subtank 30, the ink level sensors 35, 36 and 37 monitor the free ink surface in the return subtank 30 and control the draining process. Preferably the entries and exits of the subtanks are located at the bottom of the closed container and on a symmetry axis of the container that is perpendicular to the fast scan direction. The reason why becomes clear from investigating the free ink surface in the containers when the containers are being accelerated or decelerated. During acceleration and deceleration, the free ink surface inclines or declines due to inertia of the ink mass. This is illustrated in FIGS. 2A, 2B and 2C. At a symmetry plane of the container, perpendicular to the acceleration or deceleration direction, the height of the free ink surface 28 is constant, resulting in a constant hydrostatic pressure at that location. Because hydrostatic ink pressures are part of the mechanism to create a back pressure at the printhead nozzles, it is advantageous to have at least the ink exit 22 of the supply subtank 20 and the ink entry 31 of the return subtank 30 positioned at a symmetry plane of their container, perpendicular to the fast scan direction. For a reliable and steady operation, it may also be advantageous to have the ink level sensors of the subtanks measuring in these symmetry planes. The behavior of the free ink surface 28 during acceleration or deceleration is illustrated in FIGS. 2A through 2C. FIG. 2A shows a steady state free ink surface 28 when the supply subtank 20 does not accelerate nor decelerate. FIG. 2B shows the situation of an accelerating supply subtank 20 and FIG. 2C shows the situation of a decelerating supply subtank 20. In all three examples the height of the free ink surface 28, and therefore also the hydrostatic pressure, at the symmetry plane indicated is constant. As shown in the figures, the ink exit 22 is preferably located at the symmetry plane. In addition, the air volume in the closed containers 29 and 39 of the respective subtanks also acts as a high frequency damper reducing external noise. The supply subtank 20 and the return subtank 30 may be provided as separate mechanical parts or may be integrated into a single assembly, i.e. the functionality of both subtanks may be integrated in a single molded plastic part. It is preferred that the subtanks are positioned right above the corresponding printhead. This position is advantageous because the tubing and other ink connections between the subtanks and the printhead will have a minimum of horizontal ink transport sections that may be responsible for induced pressure variations during acceleration and deceleration of the printhead carriage.

With continued reference to FIG. 1 the off-axis ink system 2 is now being described. The off-axis ink system has a supply side and a return side. At the supply side the off-axis ink system includes a main ink tank 70, a supply vessel 40 and a degassing unit 60. At the return side the off-axis ink system includes a return vessel 50. The supply side and the return side are hydraulic connected via a series connection of a check valve 74, a filter 75 and a pump 76, between the ink exit 52 of the return vessel 50 and the ink entry 41 of the supply vessel 40. The pump 76 must be suited for pumping inkjet inks and should withstand the counter pressure resulting from the pressure difference between the pressure in the supply vessel 40 and the pressure in the return vessel 50. A suitable pump may be a NF60 micro-diaphragm liquid pump from KNF Neuberger. The filter 75 preferably is a filter that stops any clogged material in the returned ink from reentering the supply path. A suitable filter may be a MAC type filter from Pall. Preferably a MACCA0303 is used for UV-curable inks and a removal rating of 3 μm is targeted. This hydraulic connection enables reentry of returned ink back into the supply chain, thus creating a circulating ink system. The supply vessel 40 is, with ink entry 48, also hydraulic connected to a main ink tank 70 for supply of fresh ink into the circulation system via a series connection of a check valve 71, a filter 72 for filtering solid particles with dimensions above some 3 to 5 μm from the ink and a pump 73 which may be a peristaltic pump suited for pumping inkjet inks and withstanding the counter pressure in the supply vessel 40. The supply vessel 40 and return vessel 50 are designed so that they can be pressurized via a pressure connection 43 respectively 53. They may also contain one or more ink level sensors for monitoring the free ink surface in the vessels. The embodiment depicted in FIG. 1 uses single ink level sensors 46 respectively 56 with a hardware or software hysteresis around their switch level, for creating trigger signals to start and stop filling respectively draining operations, but other level sensing methods that can serve to trigger filling or draining operations may be applied. On the supply side of the off-axis ink system 2 there is provided an active through-flow degassing unit 60. The degassing unit has an ink entry 61 receiving ink from ink exit 42 of supply vessel 40, and an ink exit 62 supplying degassed ink to the ink supply side of the carriage ink system 3. The degassing unit further has a vacuum connection 63 for applying the vacuum used to degas the ink. The degassing unit is of a through-flow type that continuously removes dissolved gas from the ink during circulation is of the ink, up to an asymptote value of dissolved gas in the ink. The asymptote value may be a function of the applied vacuum, the ink through-flow rate and of course the degasser specifications. An example of a through-flow degassing unit suitable for inkjet inks may be a MiniModule hollow fiber membrane type degassing unit available from Membrana GmbH. Finally, the off-axis ink system is connected to the carriage ink system via two valves. A replenish valve 24 connects the supply side of the off-axis ink system 2 with the ink entry 21 of the supply subtank 20 of the carriage ink system 3. A drain valve 34 connects the return side of the off-axis ink system 2 with the ink exit 32 of the return subtank 30 of the carriage ink system 3. The replenish valve 24 and drain valve 34 may reside on the carriage, i.e. in the carriage ink system 3, or be stationary on the printer, i.e. in the off-axis ink system 2. Preferably they reside on the carriage, very close to the subtanks, so that they can stop dynamic pressure waves, generated in the tubes used to connect the carriage ink system 3 with the off-axis ink system 2, from propagating into the subtanks and further into the printhead.

By way of example, the degassing unit 60 in the embodiment of FIG. 1 is shown as part of the off-axis ink system, but the degassing unit may also reside on the carriage ink system having the advantage that the length of the ink path from the degassing unit to the printhead is reduced and thus reduce the risk of ink degradation before the ink reaches the printhead's nozzle.

Figure 7:
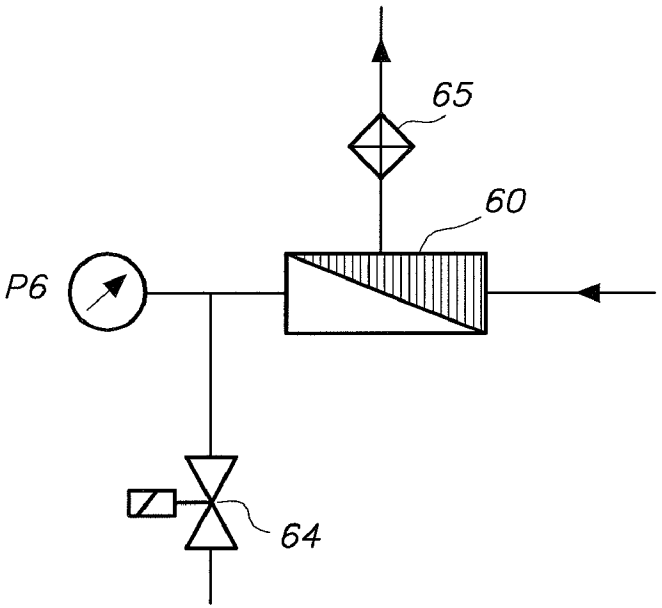
FIG. 7 shows an alternative embodiment of a degassing unit.

In FIG. 7 an even more preferred embodiment of an active degassing unit is shown. FIG. 7 only shows the active degassing module of the ink system 1 and may be integrated in the ink system depicted in FIG. 1, as part of the carriage ink system or as part of the off-axis ink system. FIG. 7 shows, in addition to the active degassing unit itself and the vacuum pressure connection 63, a vacuum break valve 64 and a filter 65. The advantages of this alternative embodiment will be explained further on when active degassing is discussed in more detail.

FIRST EMBODIMENT

Printing Mode

Figure 5:
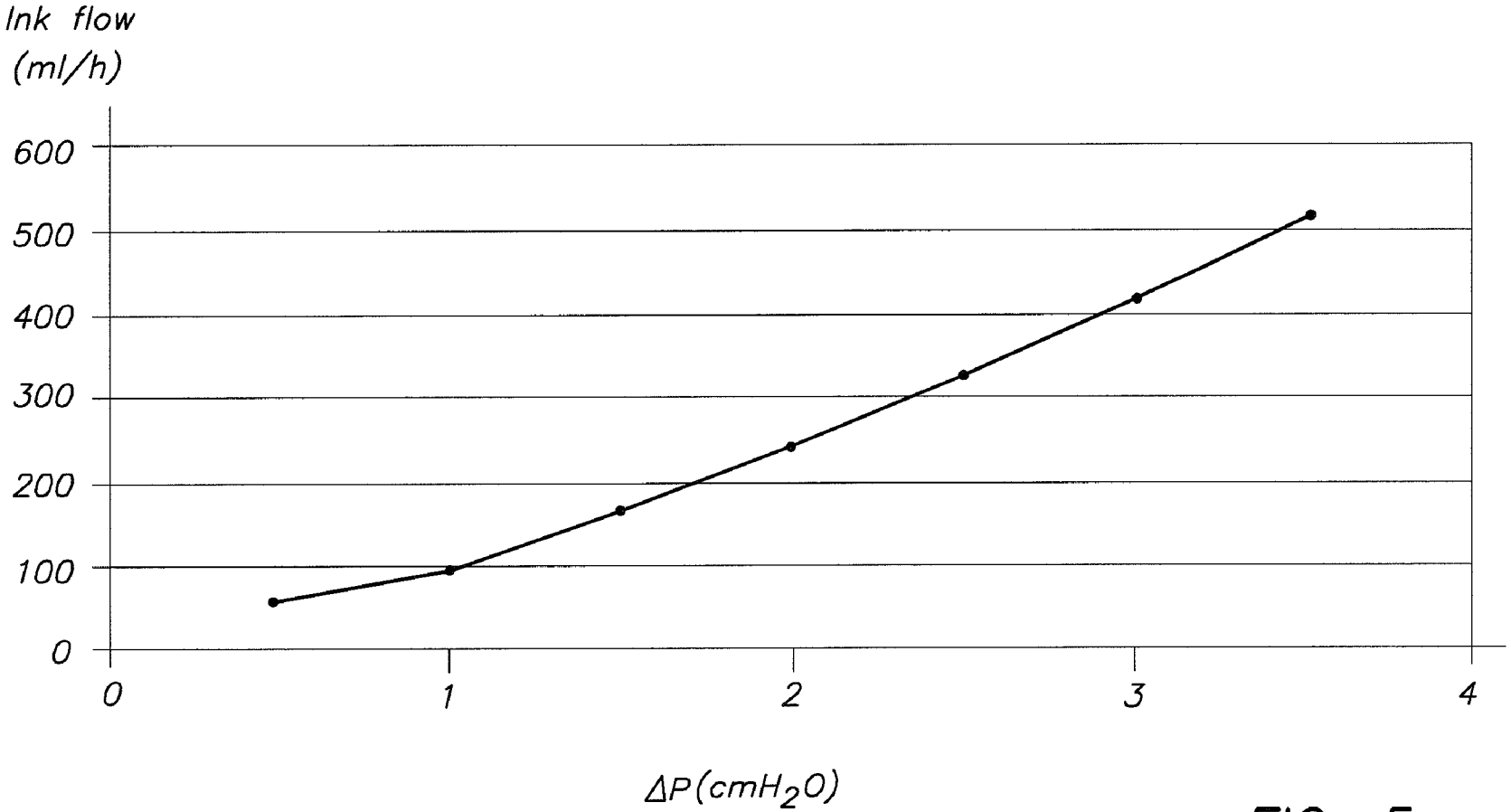
FIG. 5 shows ink flow through a printhead as a function of pressure difference between return subtank and supply subtank, in a specific embodiment of the invention.

The operation of the embodiment according to FIG. 1 in normal printing mode is now being described. An ink flow through the printhead 10 is realized by establishing a pressure difference between the pressure P2 in the supply subtank 20 and the pressure P3 in the return subtank 30. These pressures are applied via pressure connection 23 on the supply subtank 20 respectively pressure connection 33 on the return subtank 30. In order to create a positive flow from the supply subtank 20 through the printhead 10 and into the return subtank 30, the pressure in the supply subtank 20 is controlled at a slightly higher value than the pressure in the return subtank 30. The ink flow rate through the printhead is controllable via pressure difference P3−P2 but depends also on the hydraulic resistance of the fluid conducts to and from the printhead as well as the flow rate of ink through these conducts, and the hydraulic resistance internally in the printhead. In practice a pressure difference of 2.5 mbar may already provide a flow rate of over 300 ml/h through the printhead 10. In FIG. 5 a graph is shown illustrating the increase in through flow through the printhead 10 as the pressure difference P3−P2 increases. FIG. 5 is only illustrative because exact graphs depend on ink viscosity, hydraulic resistance, etc.

The back pressure at the nozzles of the printhead is controlled by means of the same pressure values P2 and P3 used to establish the ink flow through the printhead 10. In a preferred hydrodynamic symmetrical construction of the carriage ink system 3, i.e. with a balanced hydraulic resistance before and after the printhead nozzles, the back pressure at the nozzle equals ((P2+P3):2)+(ρgh) where ρgh is the hydrostatic pressure of the ink column between the free ink surface in the subtanks and the meniscus in the nozzles. In embodiments where the subtanks and the printhead are mounted on a single carriage, h values typically range between 20 cm and 50 cm. Any deviation from this preferred symmetrical construction of the carriage ink system 3 leads to unbalanced dynamic pressure drops and unbalanced hydrostatic pressures in the supply path versus the return path. This imbalance can be pre-calculated or calibrated up front so that finally the back pressure at the nozzles is perfectly controllable with the pressure in the supply subtank 20 and the return subtank 30. It is an advantage that both ink flow rate and back pressure are controllable with only two pressure values, i.e the pressure in the supply subtank 20 and the pressure in the return subtank 30. In embodiments where the subtanks and the printhead are mounted on a single carriage, the pressure values P2 and P3 are chosen so as to compensate to a large extent the hydrostatic pressure of the ink column between the free ink surface in the subtanks and the meniscus in the nozzles, and create a small back pressure in the nozzle. In a specific embodiment used to verify the invention, pressure values in normal printing mode were −30 mbar for P2 and −33 mbar for P3. These pressure values and a height difference between the free ink surface in the subtanks and the nozzles about 30 cm lead to a back pressure in the nozzles of about −1.5 mbar and an ink flow rate above 300 ml/h.

In order to sustain a continuous flow of ink through the printhead 10, the supply subtank 20 needs to be replenished continuously and the return subtank 30 needs to be drained continuously so as to keep the ink levels in the subtanks constant. After all, the back pressure in the nozzles is to some extent depending on the hydrostatic pressure of the ink columns at the supply and the return side of the printhead. And although hydrostatic pressures can be calibrated up front and taken into account when determining the set points for P2 and P3, they should be kept constant during operation. Fortunately, printheads have a back pressure operating window within which the ejection process can operate. A back pressure operating window is expressed as a hydrostatic pressure range and may go up to ±10 cm water gauge around its working point, for printheads operation in a stationary system with constant printing process parameters. But printing process parameters are seldom constant and vary also within a tolerance window around their working point, e.g. printhead manufacturing tolerances or varying dynamic pressure drops in the ink tubes. These tolerance windows consume a part of the available operating window for the printhead back pressure. In practice the free ink surface variations in the subtanks are preferably limited to ±1 cm, more preferably ±0.5 cm, most preferably ±0.1 cm. This operating window thus provides room for intermittent on/off replenishment of ink in the supply subtank 20 and drainage of the ink in the return subtank 30. Intermittent replenishment concepts may be realized using fast switching valves with switching rates in the range of 1 to 10 Hz and having a small diaphragm. Switching may be triggered by a single operating level switch with a small hysteresis defining the targeted operating window. Fast switching with low flow rates is close to a continuous replenishment concept, much like pulse width modulated power drives come close to analogue power drives, but is cheaper and easier to control. In the embodiment of FIG. 1, replenish valve 24 is opened and closed under control of one or more of the level detection sensors 25, 26 or 27 of the supply subtank 20. Depending on the back pressure operating window, the ink level detection sensors in the supply subtank 20 may be configured to allow a minimum to maximum height difference of ±1 cm, more preferably ±0.5 cm, most preferably ±0.1 cm.

An alternative embodiment for controlling the continuous flow of ink through the printhead 10 is to keep the pressure values P2 and P3, applies to the supply subtank 20 respectively the return subtank 30, equal and use hydrostatic control of the free ink surface of the respective subtanks to create a hydrostatic pressure difference between the free ink surface in the supply subtank 20 versus the return subtank 30. The hydrostatic pressure difference replaces the active pressure difference P3−P2. The hydrostatic pressure difference may be realized via a different position of the ink level sensors in the respective subtanks, feasible because the continuous ink flow will control the ink level in the subtanks towards the position of the ink level sensors in that subtank, or may be realized via a height difference of the subtanks relative to each other. This embodiment is advantageous when small pressure differences already create a desired ink flow rate through the printhead, in which case the hydrostatic difference is easily implemented without serious mechanical consequences to the implementation of the embodiment, and is advantageous because only is one pressure value P2=P3 is to be made available to the carriage ink system.

The ink in the supply subtank 20 on the carriage ink system is replenished from a supply vessel 40 located off-axis and through a through-flow degassing unit. A pressure P4 can be applied to the supply vessel 40 via pressure connection 43. The pressure P4 in the supply vessel 40 is set higher than the pressure P2 in the supply subtank 20 so as to force a flow of ink from the supply vessel 40 to supply subtank 20 when the replenish valve 24 is opened. The pressure difference P4−P2 between the supply vessel 40 and the supply subtank 20 is chosen as a function of the desired flow rate, the allowable disturbance of the free ink surface in the supply subtank 20 during replenishment, a known flow resistance in the ink path from the supply vessel 40 to the supply subtank 20, the pressure drop in the degassing unit 60, and the hydrostatic height difference between the supply vessel 40 and the supply subtank 20. The pressure P4 may be chosen in a range from 200 mbar to 1000 mbar. A practical example for pressure value P4, in combination with P2 equal to −30 mbar, may be +400 mbar. It is preferred that the pressure difference P4−P2 can create an ink flow rate of at least 1000 ml/h between the supply vessel 40 and supply subtank 20. This preferred minimum ink flow rate is related to the active degassing unit 60 that needs a minimum through flow to function properly, as will be described further on.

On the return side of the ink system 1, the ink that is returned from the printhead 10 enters return subtank 30 where the ink level rises. The ink level in return subtank 30 has a hydrostatic contribution to the back pressure regulation at the nozzles and therefore the ink level in return subtank 30 needs to be maintained within limits, in a similar way that the ink level in the supply subtank 20 needs to be maintained within limits. The ink in the return subtank 30 on the carriage ink system 3 is drained towards return vessel 50 located off-axis. A pressure P5 can be applied to the return vessel 50 via pressure connection 53. The pressure P5 in is the return vessel 50 is set lower than the pressure P3 in the return subtank 30 so as to force a flow of ink from the return subtank 30 to return vessel 50 when a drain valve 34 is opened. The drain valve 34 is opened and closed under control of one or more of the level detection sensors 35, 36 or 37 of the return subtank 30. Depending on the back pressure operating window for the printhead 10, the ink level detection sensors in the return subtank 30 may be configured to allow a minimum to maximum height difference of ±5 cm, more preferably ±1 cm, most preferably ±0.5 cm. The pressure difference P5–P3 between the return vessel 50 and the return subtank 30 is chosen as a function of the desired flow rate, the allowable disturbance of the free ink surface in the return subtank 30 during drainage, a known flow resistance in the ink path from the return subtank 30 to the return vessel 50, and the hydrostatic height difference between the return vessel 50 and the return subtank 30. The pressure P5 may be chosen in a range from −100 mbar to −950 mbar. A practical example for pressure value P5, in combination with P3 equal to −40 mbar, may be −300 mbar. It is preferred that the pressure difference P5-P3 can create an ink flow rate of at least 1000 ml/h between the return subtank 30 and return vessel 50. The ink that is returned in the return vessel 50 is used to replenish supply vessel 40, to be described now.

To assure a constant supply of ink to and a drainage of ink from the carriage ink system 3, the supply vessel 40 of the off-axis ink system 2 continuously needs to have ink available while return vessel 50 of the off-axis ink system 2 continuously needs to have draining capacity available. This is achieved by filling and draining operations for the supply vessel 40 respectively return vessel 50. These operations are less critical with respect to maintenance of precise ink levels in the vessels 40 and 50. The supply vessel 40 may be replenished via ink entries 41 and 48, from two sources: a hydraulic connection with return vessel 50 via ink exit 52 will replenish supply vessel 40 with returned ink from the printhead, and a hydraulic connection with the main ink tank 70 will replenish supply vessel 40 with fresh ink to compensate for the ink is that was ejected from the printhead. One of possible procedures may be that replenishment of supply vessel 40 is triggered by ink level sensor 46 and starts with ink coming from return vessel 50, by default and if possible. If during this replenishment process the ink level in the return vessel 50 would become insufficient to further support the replenishment process, i.e. an underflow condition occurs, replenishment via return vessel 50 is interrupted and replenishment is taken over by the main ink tank 70, until the amount of ink returned into vessel 50 is again sufficient to further support the replenishment process via return vessel 50. The cause of an underflow condition in the return vessel 50 is ink consumption by the printhead 10. As ink is consumed, i.e. printed, the total amount of ink circulating in the ink system 1 gradually decreases and the ink in one of the intermediate ink storage elements of the ink circulating system, i.e. one of the subtanks or one of the vessels, will go in an underflow condition i.e. below its normal operating ink level. It is preferred to allow this underflow condition only to happen in return vessel 50, because the ink level in return vessel 50 is the least critical to the operation of the complete circulation system. The line between having an underflow condition or not in return vessel 50 is somewhat arbitrary, but may for example be chosen so as to guarantee ink replenishment to supply vessel 40 during the time frame of a main tank replacement operation, i.e. during a time that the supply vessel 40 can not be replenished via main tank 70. An underflow condition in return vessel 50 may be detected via ink level sensor 56.

The replenishment process with fresh ink via pump 73 may operate under the control of the underflow detection in return vessel 50, under the control of a printer controller that keeps track of the amount of ink consumed by the printhead for printing, or be operated manually in the event of emptying the main tank by an operator before replacing it with a new one.

Figure 8:
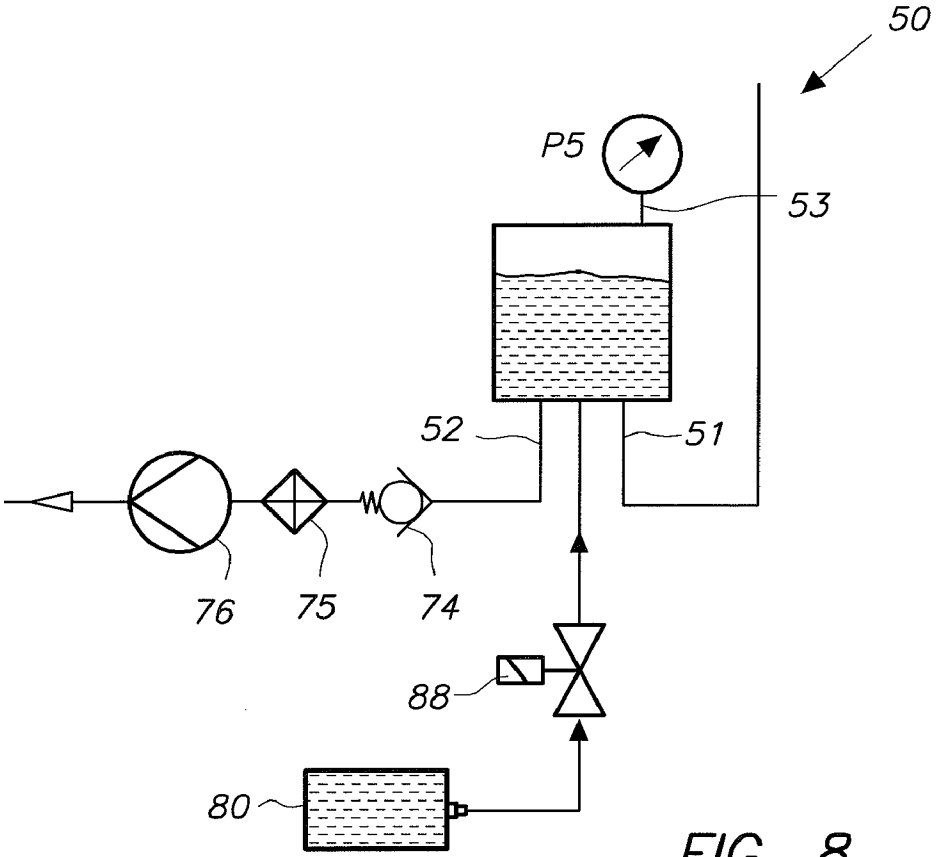
FIG. 8 shows an alternative embodiment of replenishment of the ink system with fresh ink.

An alternative to a progressive replenishment of supply vessel 40 from main ink tank 70, as ink is consumed and printed by the printhead, is a one-time replenishment with the full content of a main ink tank. A possible embodiment of this alternative is illustrated in FIG. 8. In FIG. 8 return vessel 50 is also used as a buffer vessel. Return vessel 50, being at a negative pressure P5, may suck out a full ink cartridge 80 when the cartridge 80 is hydraulically coupled to the return vessel 50, provided the return vessel 50 can store the volume of ink in the cartridge 80. The advantage of this embodiment is that uploading an amount of fresh ink in the circulation system 1 is a one-time action of an operator, after which that operator has plenty of time to replace the empty ink cartridge 80 with a new one. Preferably there is a valve 84 in between the ink cartridge 80 and the return vessel 50 to control start and stop of the uploading process. In the uploading process there is no pump involved which is also an advantage; the negative pressure P5 in the return vessel 50 establishes the pumping action. Depending on the ink consumption in the ink system, i.e. the amount of ink printed by the printhead(s), it may be advantageous to have the cartridge 80 replaced by a jerry can when ink consumption is high. Cartridges typically provide an amount of ink up to about 1 or 2 liters. Jerry cans on the other hand can easily provide ink amounts above 2 liters.

FIRST EMBODIMENTS

Non-Printing Modes

The pressure P2 in the supply subtank 20 can be selected from at least three preset values P21, P22 and P23 that correspond to different operating conditions of the printhead 10. These preset pressure values for the supply subtank 20 cooperate with a parallel set of preset values P31, P32, P33 for the pressure P3 in the return subtank 30. A first operating condition of the printhead corresponds with a normal printing condition that has been described previously. For this purpose a set of valves (see FIG. 1) could be operated to link preset values P21 and P31 to their respective subtank.

A second operating condition of the printhead may be a purging operation, wherein the pressures applied to the nozzles is such that ink is flows out of the nozzles without actuating the nozzles. For a purging operation, equal positive pressures are applied to the supply subtank 20 and the return subtank 30. In this case there is no through-flow in the printhead 10 and all the ink available in the supply subtank 20 and the return subtank 30 is purged through the printhead nozzles. It is clear that a purging condition can also be created by means of two positive but unequal pressures, in which case a through-flow will be created in the printhead 10. In the embodiment of FIG. 1 preset pressures P22 and P32, either equal or different, may be selected to create purging conditions. Purging of ink jet printheads can be done with pressures between 50 mbar and 500 mbar. A practical example for the embodiment in FIG. 1 may be to set P22 and P32 equal to 150 mbar.

A third operating condition of the printhead 10 is used to create a sweating nozzle plate prior to wiping the nozzle plate during maintenance of the printhead. A sweating nozzle plate can help soak or detach any dirt at the nozzle plate before wiping the nozzle plate with a wiper blade. The pressure required for a nozzle to start sweating is typically a little less negative than the operational back-pressure, i.e. just outside the back-pressure operating window in the positive pressure direction. Sweating of a nozzle plate can be realized with pressures between 0 mbar and 50 mbar at the meniscus, so slightly positive whereas the nozzle back pressure for normal printing is slightly negative. As for the purging operation, nozzle plate sweating may be realized with equal pressure values P23 and P33 in the supply subtank 20 respectively return subtank 30, in which case there is not flow through the printhead 10, which is not a requirement for this operation mode. A practical example for the embodiment in FIG. 1 and with a height difference h between the free ink surface in the subtanks and the nozzle plate of about 30 cm, P32 and P33 may equal −26 mbar so as to create a slightly positive pressure at the nozzle.

As is depicted in FIG. 1 the different preset values for the pressure in the supply and the return subtank may be provided from a pressure generation subsystem, shown very schematically as several pressure regulator pictograms, and a set of valves. The valves may be part of the subtank assembly they belong to, and as such part of the carriage ink system 3. In this case each subtank assembly is connected to a plurality of pressure tubes coming from the pressure regulating system that may be located off-axis. Alternatively the valves may be located off-axis, in which case each subtank assembly on the carriage has only one pressure tube connection to the off-axis valve configuration. It is strongly depending on the printer configuration to determine which setup for pressure distribution is preferable. If multiple printheads are used, each with their individual supply and return subtank, a single pressure bar could be used distributing each of the preset pressure values to all of the application points on the multitude of printhead subtanks. A further optimization is possible if all the printheads in the printhead configuration always operate in the same mode, i.e. they print simultaneously, are purged simultaneously or wiped simultaneously. In this case pressure switching can be done off-axis and only one pressure bar is needed to distribute the selected preset pressure to all of the application points.

Active Degassing

It has been known from the prior art that jetting reliability of printheads may be significantly increased by providing degassed ink to the printhead. In the field of inkjet printing, degassing is also referred to as air-removal or de-aerating. It is the process of reducing the amount of gas, e.g. oxygen or nitrogen or other gasses, dissolved in the ink. The embodiment of the invention depicted in FIG. 1 includes an active degassing unit 60 to control the amount of gas in the ink. The term "active" refers to the property of being able to control the dissolved gas removal level of the ink towards a target value, often referred to as a control set point. Process parameters that may be available to control the dissolved gas removal level can be the vacuum pressure used with the degassing unit, the ink flow rate through the degassing unit, the type of semi-permeable membrane used in the degassing unit, etc. Active control of the dissolved gas removal level has the following advantages. On the one hand, the amount of dissolved air in the ink can be controlled to be as low as possible to prevent cavitation of the ink during fast pressure changes in printhead ink chambers, e.g. MHz range variations for piezoelectric inkjet printheads. On the other hand, the amount of dissolved air in the ink can be controlled not to be too low because the chemical stability of the ink may become a problem. For example a UV curable ink may start spontaneous (thermal) curing when the amount of oxygen in the ink is too low. With active degassing, the dissolved gas removal level of the ink can be controlled within minimum and maximum levels. It has also been found that the dissolved gas level of the ink is susceptible to changes during its stay in the ink system. E.g. the ink supply side of an ink system may comprise several components that are not 'airtight' and therefore allow exchange of gas between the ink and its environment. This is of course a relatively slow process, but when ink resides hours, days or weeks in an ink system without being used, this aeration process become relevant.

Figure 6:
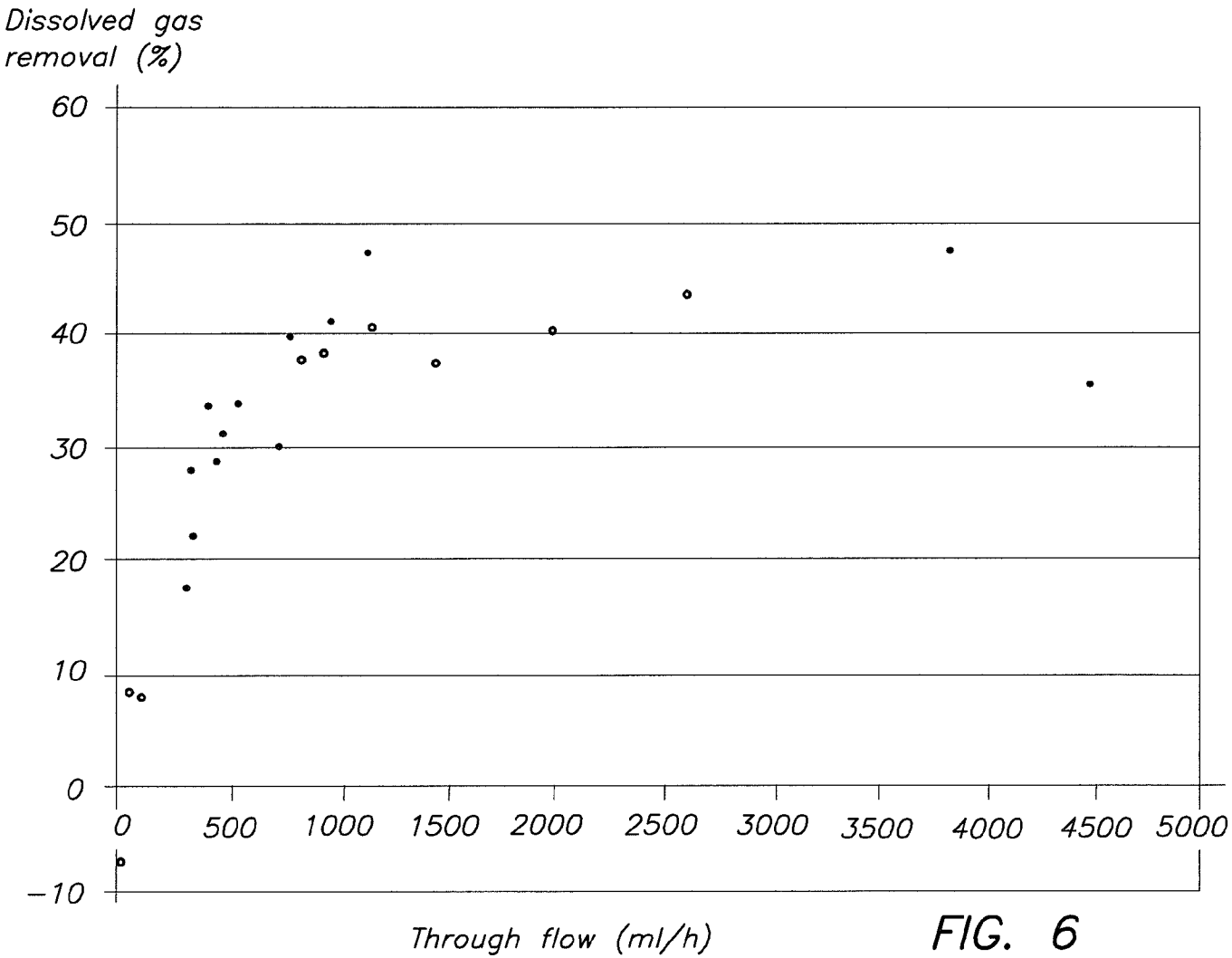
FIG. 6 shows dissolved gas removal efficiency as a function of ink flow through the active degassing unit, in a specific embodiment of the invention.

An ink system according to the present invention therefore includes an active through-flow degassing unit 60 that controls the continuously circulating ink towards a target dissolved gas level. An example of a through-flow degassing unit suitable for inkjet inks is a MiniModule hollow fiber membrane type degassing unit available from Membrana GmbH. The Celgard® hollow fibers are hydrophobic and provide a surface area for a liquid and a gas phase to come into direct contact with each other without the liquid penetrating the pores. These hollow fibers do not suffer from getting silted up, a problem that porous membrane type degassing units may have. Generally, in through-flow degassing units, the dissolve gas removal is a function of through-flow rate of the ink, the type of ink, the applied vacuum pressure P6 and of course the construction of the degassing unit itself. It has been found that the dissolved gas removal level of the ink reaches an asymptotic value after two or three passes of the ink through the degassing unit. A through-flow active degassing unit as part of an ink circulation system allows the ink system to provide degassed ink of the right quality to the printhead almost instantly and continuously. The degassed ink delivery is independent of print throughput (ink consumption rates), maintenance or purge operations, printer restart, stops for media change over, etc. The printer will be able to reliably print from the first centimeter of the printing medium on. It has also been found that the dissolved gas removal process works efficiently only with a minimum ink through flow. Measurements of dissolved gas removal as a function of through flow through the degassing unit have been depicted in FIG. 6. Figure shows that the most efficient operating window of the degassing unit is above a through flow of 1000 ml/h.

An alternative to targeting an asymptote value for the dissolved gas removal level of the circulating ink, is the use of an aeration module combined with a degassing unit. The aeration module may be inserted in the ink circulation circuit in front of the degassing module and bring the dissolved gas level of the ink back to an equilibrium or saturation level. Such an aeration module may comprise for example a depressurizing valve reducing the pressure of an available pressed air connection towards a suitable pressure value for injecting air in a already pressurized component in the ink system. For example, if the aeration module is connected to the ink supply vessel 40 that is pressurized to a pressure P4, the air should be injected at a pressure above P4. Between the depressurizing valve and the supply vessel 40, a control valve is located to control the air injection process, e.g. on/off. In addition to the depressurizing valve and the control valve, there may be agitation means to speedup the gas dissolving process in the ink. The degassing unit being downstream the aeration module always receives ink with an equilibrium amount of dissolved gas and always outputs ink with a reproducible level of dissolved gas removed, the level being dependent on manufacturing settings or operation settings of the degassing unit.

The aeration module may be inserted in the ink circulation system 1 at a location after the return subtank 30 and before the degassing unit 60, and is preferably inserted near the return vessel 50.

In the embodiment of the invention depicted in FIG. 1, the through-flow degassing unit 60 is a separate module in the ink circulation system 1. There are several advantages linked to this configuration. Firstly there is an advantage towards maintenance by providing the degassing unit 60 as a replaceable module in the ink system 1, as opposed to for example a degassing unit integrated in the printhead. This advantage is important because a degassing unit 60 may have a shorter lifetime than the printheads in the printer and may require regular maintenance such as cleaning, back-flushing, etc. Secondly there is an advantage towards fit-for-use, i.e. the degassing unit characteristics may be chosen as a function of the ink type, the expected through-flow rates, or other printer parameters. All these considerations make a individual degassing unit favorable.

In FIG. 7 an alternative embodiment is depicted for the active degassing module. The alternative embodiment includes a vacuum break valve 64 and a filter 65. The vacuum break valve 64 breaks the vacuum applied to the degassing unit 60 in the event that ink circulation is stopped for whatever reason, e.g. machine stop, or when the ink flow through the degassing unit 60 is below a minimum value. It has been found that some ink types degrade when retained in an operational degassing unit too long. For example UV-curable inks start to cure when retained too long in the degassing unit under vacuum pressure. Gels start to be formed within the ink that may disturb the jetting performance of the printhead significantly. Therefore a second precaution is taken to reduce the risk of gels entering the printhead, i.e. the additional filter 65 is placed between the degassing unit 60 and the supply subtank 20, physically located as close as possible to the supply subtank 20. The filter 65 filter the gels out of the ink.

Figure 11:
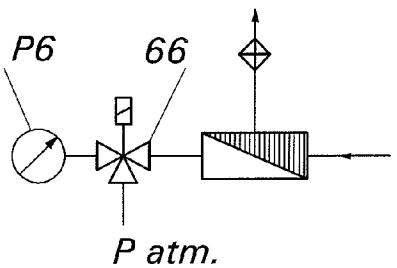
FIG. 11 shows an embodiment of a degassing unit with a controllable vacuum connection.

FIG. 11 shows an even more preferred embodiment of the degassing unit 60, wherein the vacuum connection 63 of the degassing unit 60 is connected to a control valve 66 allowing the vacuum applied to the degassing unit 60 to be controlled at a target vacuum pressure value. The control valve 66 controls the vacuum pressure by switching between a fixed vacuum P6 and atmospheric pressure $P_{atm}$. A valve suitable for this type of control may be a 3/2-way Rocker valve available from Bürkert Flduid Control Systems (UK). The advantage of controlling the vacuum applied to the degassing unit 60 is that the vacuum pressure can be adjusted as a function of a number of operating parameters of the ink circulation system, e.g. the flow rate of the ink through the degassing unit 60, the type of ink used, the ink temperature, the average amount of passes of the ink through the circulation system, etc. The embodiment of FIG. 11 may also be used in an on/off switching mode for applying either the fixed vacuum P6 or the atmospheric pressure $P_{atm}$ to the degassing unit 60. The on/off use of the 3/2-way valve may be controlled by operating events, e.g. during circulation standstill, during non-printing periods, etc.

Alternative Subtank Embodiment

Figure 3:
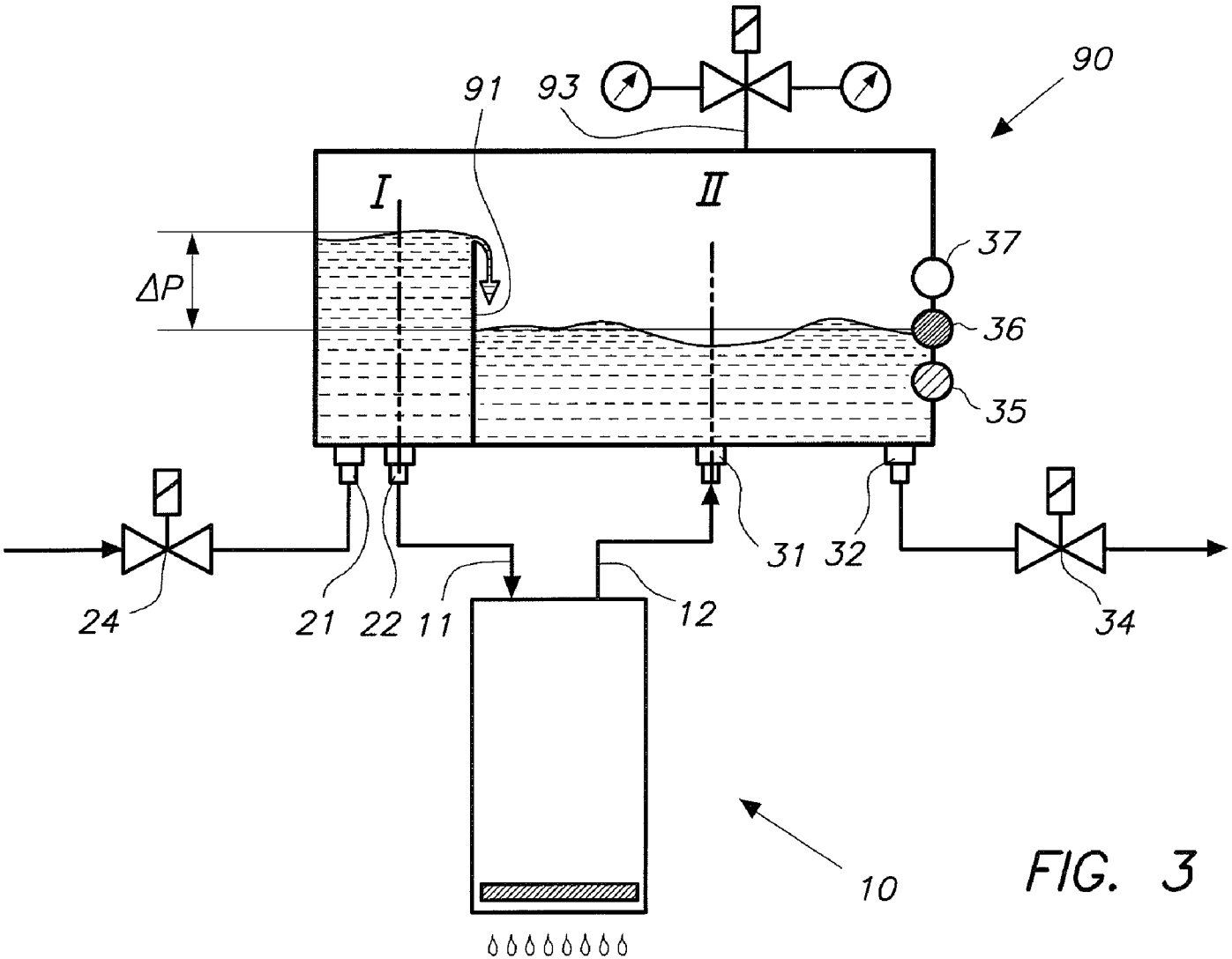
FIG. 3 shows a schematic view for an alternative embodiment of a subtank.

In the first embodiment the supply subtank 20 and return subtank 30 are separate modules with similar mode of operation. An alternative design is shown in FIG. 3. Where possible, reference numbers from FIG. 1 are reused for features with similar functionality. A printhead subtank 90 is provided with a first compartment I and a second compartment II separated by a wall 91 fixed to a bottom of printhead subtank 90 and used as an overflow from compartment I to compartment II. Ink continuously overflows from compartment I into compartment II via overflow wall 91. So the ink level in compartment I is constant and not measured, while the ink level in compartment II is not constant and therefore measured with ink level sensors 35, 36 or 37, having similar functionality as those described together with the return subtank 30 of the first embodiment. The ink level measurement in compartment II may control replenish valve 24 and/or drain valve 34 to keep the ink level in compartment II of printhead subtank 90 within an allowable operating window (see previous discussions). Replenish valve 24 and drain valve 34 may be chosen to be reducing valves that reduce the full ink supply pressure and drain pressure of e.g. +400 mbar respectively −300 mbar, so that a continuous and steady flow of ink can be established through printhead subtank 90. This is different from the first embodiment described together with FIG. 1, wherein the replenish valve and drain valve were switching valves and where operated on a high frequency open/close basis.

The printhead subtank 90 has an ink exit 22 linked to ink inlet 11 of the printhead for providing ink from compartment I to the printhead, and en ink entry 31 linked to ink outlet 12 of the printhead for returning ink from the printhead into compartment II of printhead subtank 90. The height difference between the ink levels in compartment I and compartment II of printhead subtank 90 creates a hydrostatic pressure difference ΔP between ink exit 22 and ink entry 31, so that a flow of ink from ink exit 22 through the printhead 10 and back to ink entry 31 is spontaneously established. ΔP is functionally comparable with the pressure difference P3-P2 in the first embodiment of the invention.

Pressure connection 93 may be used to superimpose a pressure onto the printing ink pressure, established via valves 24 and 34, for either non-printing operation or for adjusting the printing conditions. E.g. purging operation or a forced sweating of the nozzle plate.

A variant to the overflow wall 91 as depicted in FIG. 3 may be a wall extending from the bottom of the subtank all the way to the top of the subtank, and having only one opening serving as overflow opening. Statically this variant would be equivalent to the wall 91 in FIG. 3, but dynamically it prevents large ink quantities being spilt from compartment I into compartment II when accelerating and decelerating the subtank on a printhead carriage, thereby distorting the hydrostatic pressure balance.

Use of additional partitions in compartment II used as breakwaters will further stabilize the free ink surface in compartment II as the subtank 90 is reciprocated on the carriage.

Valve 24 may be replaced by a continuous running pump as it serves mainly to maintain a continuous overflow condition from compartment I to compartment II. Control of the ink level in compartment II may be realized with valve 34 only.

Embodiments for Specific Printer Configurations: Stationary Printhead

In a stationary inkjet printhead configuration, dividing an ink system in an off-axis ink system and a carriage ink system may be somewhat artificial because there are no scanning components. Nevertheless it may be advantageous to keep components that operate very closely with the printhead, like the supply subtank and the return subtank, physically grouped together with the printhead in a 'carriage' subassembly. One of the evident advantages being less static or dynamic pressure drop between the subtanks and the printhead.

Embodiments for Specific Printer Configurations: Multiple Printheads

While FIG. 1 shows an ink system including only one printhead, it is clear to the person skilled in the art that multiple printheads may be included as well. Different ink system configurations are possible.

The off-axis ink system may be common for all the printheads while the carriage ink system from FIG. 1 is duplicated a number of times according to the number of printheads in the configuration. It may be advantageous to have an individual supply subtank and return subtank dedicated to each printhead because this would allow individual maintenance of the printhead, individual back-pressure control and through-flow control, and individual buffering of acceleration or deceleration inertia forces on the ink. The additional ink tubing resulting from the use of individual supply and return subtanks for each printhead may be reduced by mechanically integrating the subtanks and the printhead into a single functional and compact subassembly.

In stationary printhead applications or less critical reciprocating printhead applications, a number of components in the carriage ink system may be grouped together. The advantage being a simpler ink system with overall less components. As an example the return subtanks of the multitude of staggered printheads, construing a single page wide printhead, may be combined into a single return subtank that serves all of the printheads in the page wide printhead assembly. This setup allows individual back-pressure control via the pressure in the individual supply subtanks that are still allocated to each of the individual printheads, but purging would be organized for all the printheads in the page wide printhead assembly simultaneously. A number of other combinations are possible, depending on the functional specifications the person skilled in the art would integrate into the ink system and its operation.

A mechanical simplification of the carriage ink system in reciprocating printhead configurations is also possible. The plurality of supply subtanks, one for each printhead, may be combined into a single supply subtank serving all printheads. The single supply subtank can still be part of the carriage ink system and be mounted on the carriage for reciprocating back and forth, together with the printheads. This embodiment has the advantage of limiting the number of subtanks on the carriage and still preventing the pressure waves in the ink tubes between the carriage ink system and the off-axis ink system from entering the printheads. Between the single supply subtank and the plurality of printheads, a plurality of valves may be used to individually cut off the printhead from the ink supply. In normal printing mode each valve would be open to allow ink supply from the single subtank to the printheads. Closing of the valves is advantageous in non-printing mode. For example, if a printhead from the plurality of printheads on the carriage needs to be purged during maintenance, the pressure in the single supply subtank, and therewith the back pressure in the nozzles, is raised and ink is pushed out of the printhead nozzles. If the valves corresponding with the printheads not requiring a purging operation are closed, these printheads are cut off from the raised ink pressure in the single supply subtank thereby excluding them from the purging operation and saving significant ink amounts. In general terms, when multiple printheads printing the same ink are used, a single off-axis ink system supplies and distributes the ink to the multitude of printheads within the carriage ink system. If n printheads are involved each requiring a minimum ink through flow for the printhead to operate properly, then the off-axis ink system needs to be designed to supply n times that minimum amount of ink flow to the carriage ink system where that ink flow will be distributed.

ALTERNATIVE EMBODIMENT

"Common Rail"

Figure 9:
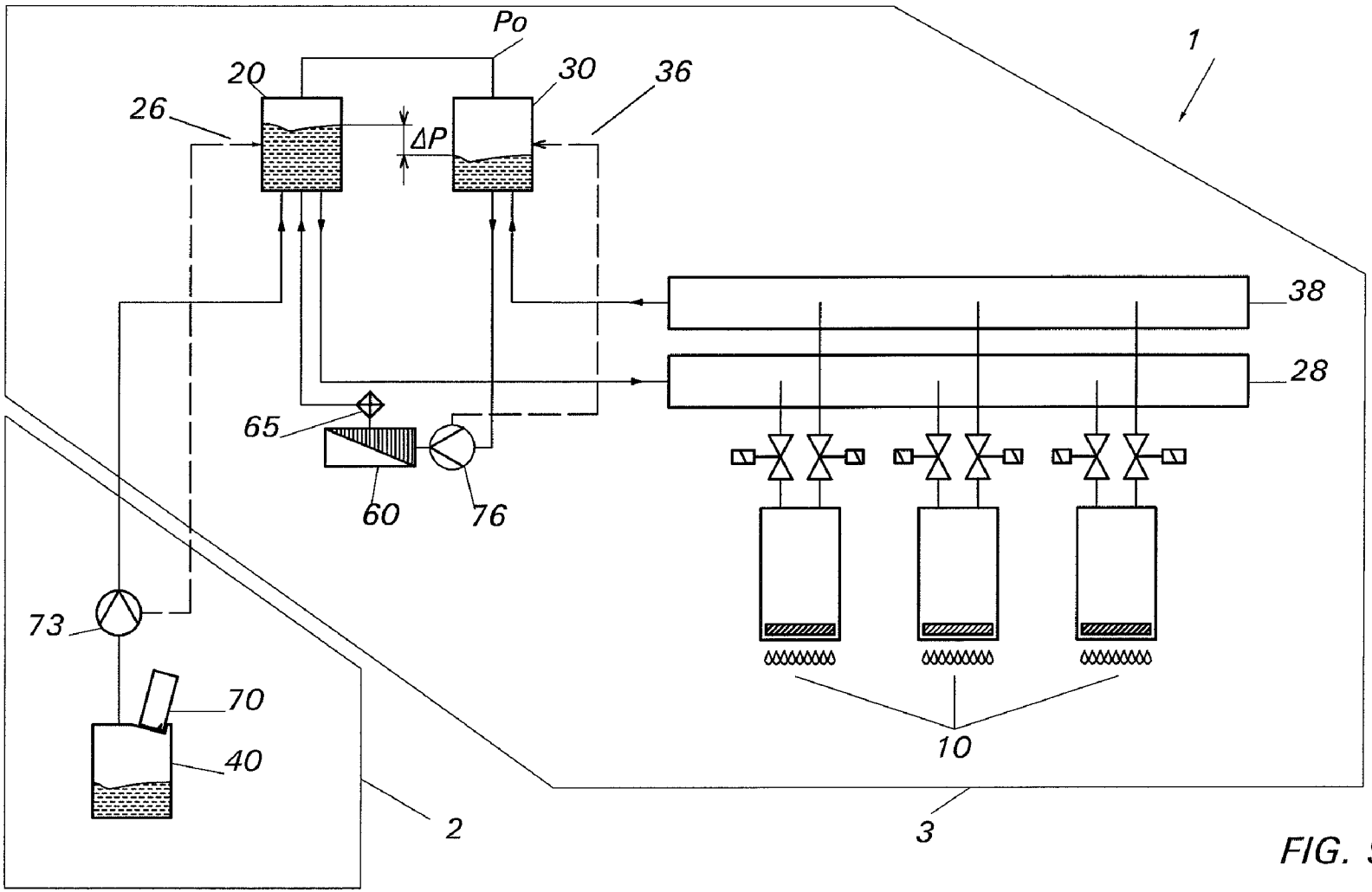
FIG. 9 shows an alternative embodiment of an ink circulation system, especially suitable for multiple printhead configurations.

With reference to FIG. 9, an embodiment is described for an ink circulation system, especially suitable for multiple printheads configurations and embodying a number of design alternatives mentioned here above. The alternative embodiment includes an ink supply subtank 20 and ink return subtank 30 having similar functionality as described before. The supply subtank 20 and return subtank 30 are equipped with ink level sensor 26 respectively ink level sensor 36. A preferable embodiment of the level sensors 26 and 36 may include an ultrasonic level sensor with a switching output or analogue output as available from Hans Turck GmbH & Co (DE) or a floating member having a magnet, arranged in the subtank, and associated therewith a set of Hall detectors, arranged at the outside of the subtank along a vertical wall. The number of Hall detectors in the set determines the degree of binary towards continuous measurement. The level sensors may be used to maintain a height difference between the free ink surface in supply subtank 20 and the free ink surface in return subtank 30. This height difference created a hydrostatic pressure difference $\Delta P$ that is the driving force for the ink flow through the printhead, as will be explained now. The supply subtank 20 provides ink to a supply collector bar 28 that may for example be an extruded profile from an ink resistant material (e.g. stainless steel). The supply collector bar 28 has multiple connections to the ink inlets of the multiple printheads 10. The ink outlets of the multiple printheads 10 are connected to a return collector bar 38, that is in turn connected to the return subtank 30. The supply collector bar 28 and return collector bar 38 replace a significant amount of ink tubing between subtanks and printheads, and therefore provide a significant advantage. Moreover, the collector bars may dimensioned to reduce the flow resistance of the ink path from the supply subtank 20, through the printheads 10 and back to the return subtank 30 to almost zero. The printheads 10 are connected to the collector bar 28 and 38 via actuated valves that can switch off each individual printhead 10 from the ink system, as depicted in FIG. 9. The valves have two major advantages: (1) in a non-operational mode of the printer, the printhead may be shut off from the ink system thereby reducing the risk for ink leakage from the ink system via the nozzles of the printhead, e.g. because of a loss of back pressure at the nozzles, and (2) in a maintenance operation, those printheads that do not require purging can be left out by shutting them off from the ink system before applying the increased purge pressure to the ink system thereby reducing the amount of ink wasted for purging. The back pressure at the nozzles of the multiple printheads is actively controlled via pressure P0 applied at the free ink surfaces of the supply subtank 20 and the return subtank 30. The ink system is closed via an ink path from the return subtank 30 back to the supply subtank 20 via pump 76, degassing unit 60 and filter 65. Preferred embodiments of the pump, the degassing unit and the filter have been described in previous sections. The pump 76 is operated under control of the level sensor 36 of the return subtank 30, similar to the operation of the drain valve 34 in previous discussed embodiments. The ink circulation system of FIG. 9, as described so far, may be located at the carriage of an inkjet printing device. The embodiment is especially suitable for inkjet printing devices of an industrial type where it is no problem for a robust reciprocating carriage to support the ink circulation system. Off-axis there are located a supply vessel 40 and pump 73 for replenishing the supply subtank 20 with fresh ink, as ink is consumed by the printheads 10. The pump 73 is operated under control of the level sensor 26 of the supply subtank 20. A pump is used instead of a replenish valve as in previous embodiments because the ink in the supply vessel 40 is maintained at ambient pressure. The supply vessel 40 comprises a docking for a main ink tank, e.g. a jerry can type, that is automatically emptied when docked. One embodiment may for example provide a knife in the docking that automatically breaks a seal in the jerry can when the can is docked; the jerry can is emptied through gravity.

The embodiment as depicted in FIG. 9 has multiple advantages: reduction of the number of fluid connections and tubing, local (on-carriage) ink circulation and degassing, ink circulation system with less components, pumped ink circulation instead of pressurized ink circulation which is safer in the event of problems, minimal interaction between the carriage ink supply part and the off-axis ink supply part, only one supply subtank and return subtank for the multitude of printheads in the configuration, etc.

It is obvious that the concept of a collector bar is not limited to the ink circulation system described, but that the concept may be applied in other configurations wherein a plurality of inkjet printheads needs to be connected to a common supply or return of ink.

ALTERNATIVE EMBODIMENT

"Optigass"

Figure 10:
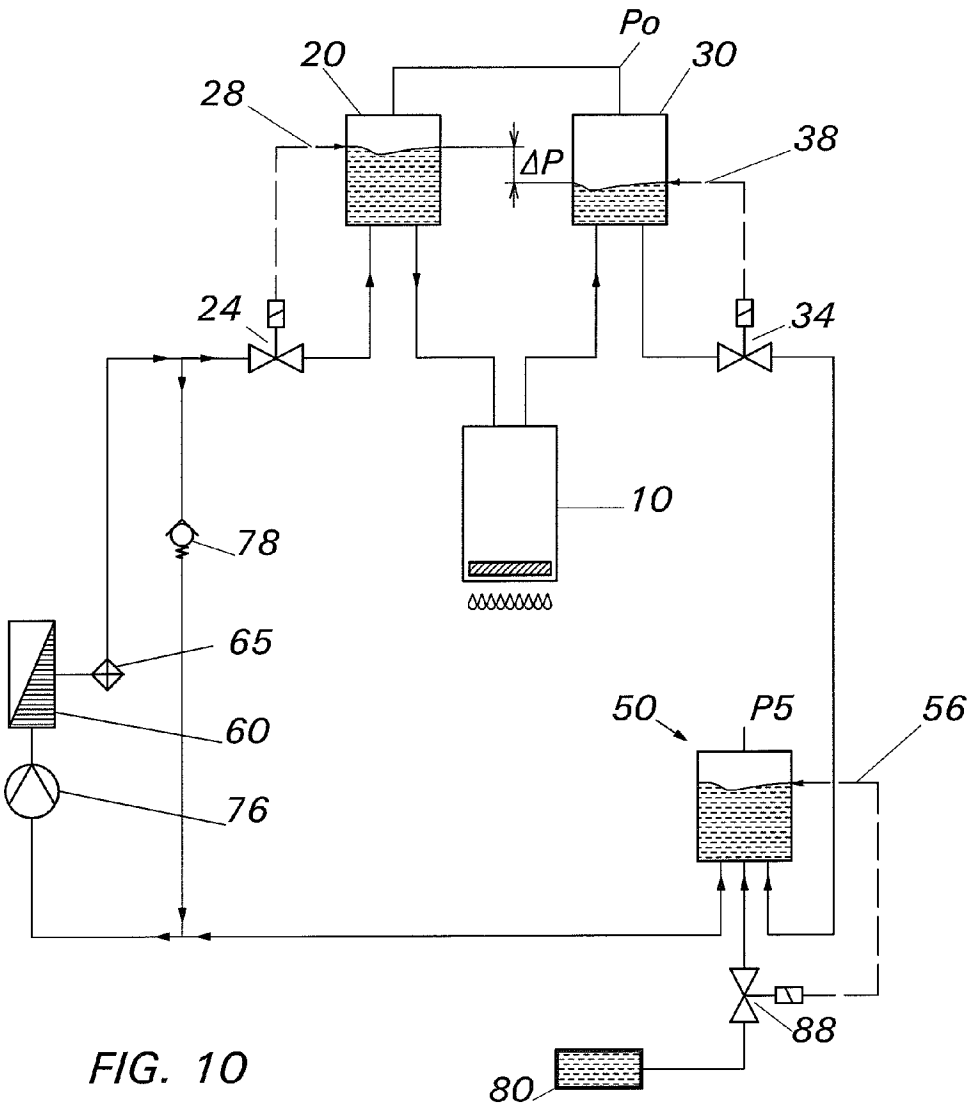
FIG. 10 shows an alternative embodiment of an ink circulation system with improved operation of a degassing unit.

With reference to FIG. 10, an alternative embodiment is described for an ink circulation system, especially suitable for improved operation of the degassing unit. It has been stated before that for optimal operation of an active through-flow degassing unit a minimum ink flow through the degassing unit is required. According to FIG. 6, this minimum ink flow is about 1000 ml/hr. In previous embodiments of the ink circulation system, the ink flow through the degassing unit was also the ink flow through the printhead. In a number of applications, an optimal ink flow through the degassing unit may not be an optimal ink flow through the printhead. The ink circulation system depicted in FIG. 10, provides a solution to this problem in that it allows a higher flow through the degassing unit than the flow through the printhead. The embodiment in FIG. 10 includes an ink supply subtank 20 and ink return subtank 30 having similar functionality as described before. The supply subtank 20 and return subtank 30 are equipped with ink level sensor 26 respectively ink level sensor 36. A preferable embodiment of the level sensors 26 and 36 may include an ultrasonic level sensor with a switching output or analogue output as available from Hans Turck GmbH & Co (DE) or a floating member having a magnet, arranged in the subtank, and associated therewith a set of Hall detectors, arranged at the outside of the subtank along a vertical wall. The number of Hall detectors in the set determines the degree of binary towards continuous measurement. The level sensor may be used in FIG. 1, i.e. the level sensor 28 is used to control the replenish valve 24 and the level sensor 38 is used to control the drain valve 34. The level sensors may also be used to maintain a height difference between the free ink surface in supply subtank 20 and the free ink surface in return subtank 30. This height difference created a hydrostatic pressure difference $\Delta P$ that is the driving force for the ink flow through the printhead 10. The pressure difference $\Delta P$ controls the flow rate of ink through the printhead 10. The back pressure at the nozzles of the printhead 10 is actively controlled via pressure P0 applied at the free ink surfaces of the supply subtank 20 and the return subtank 30. The ink circulation system further comprises a return vessel 50 for draining the return subtank 30 when the drain valve 34 is opened, driven by a negative pressure difference P5-P0. The return vessel 50 may be uploaded with an amount of fresh ink from a cartridge 80, driven by a negative pressure P5 in the return vessel 50. The amount of fresh ink is to replace the amount of ink printed by the printhead 10. Therefore the ink level in the return vessel 50 may be measured with a level sensor 56. A preferred embodiment of the level sensor 56 may be a T/LL 55 level sensor available from Fozmula (UK) or an ultrasonic type level sensor similar to the one used for the subtanks (see above). The ink path provided by the component discussed so far with reference to FIG. 10, i.e. from the replenish valve 24 up to the return vessel 50, is further referred to as the main path. The ink system is closed via a conditioning path from the return vessel 50 back to the replenish valve 24, the conditioning path comprising a circulation pump 76, a degassing unit 60 and a filter 65. Preferred embodiments of the pump, the degassing unit and the filter have been described in previous sections. Parallel to the conditioning path a bypass path is provided, comprising a flow restriction 78 that allows ink to flow from the output of the filter 65 back the input of the circulation pump 76, thereby bypassing the main path through the printhead 10. Embodiments of a flow restriction 78 may include a restriction valve, a reduction valve, a spring-loaded check valve or a simple constriction in the ink tube. The operation of the bypass path is explained now. The circulation pump 76 operates continuously and pumps ink at a given flow rate through the degassing unit 60 and the filter 65 to provide ink at the branch of the main path and the bypass path. Two situations may occur. In a first situation, the replenish valve 24 is closed and all of the ink coming from the conditioning path flows into the bypass path, through the flow restriction 78 and against the flow resistance provided by of the flow restriction 78. The operation of the circulation pump 76 increases the ink pressure at the branch of the main path and the bypass path to a value that counters the pressure resistance of the flow restriction 78. The circulation pump 76 continuously circulates the ink in a closed loop with the filter 65 and the degassing unit 60. This closed loop circulation is therefore referred to as the conditioning circulation. In a second situation, replenish valve 24 is opened and the ink coming from the filter 65 flows into supply subtank 20, against a counterpressure P0 in the supply subtank 20 that is generally lower than the counterpressure set by the flow restriction 78. The circulation pump 76 now supplies ink to the main path. The ink flow rate through the main path is determined by the pressure difference between the free ink surfaces in the subtanks 20 and 30, and may also be determined by the absolute pressure P0 in the subtanks 20 and 30. This ink circulation is referred to as the print circulation. During print circulation, the ink flow through the flow restriction 78 may be negligible or entirely cut off, depending on the specific embodiment used to realize the flow restriction 78. In operation, replenish valve 24 is operated intermittently at high frequency, creating a controllable pseudo-continuous ink flow through the main path during printing. That is, in operation, replenish valve 24 is functionally comparable with a controllable flow restriction. The replenish valve 24 and the flow restriction 78 therefore allow two parallel ink flows, i.e. a print flow via the main path (including the printhead) and a conditioning flow via the bypass path. From these two ink flows, the print flow is controllable and the conditioning flow takes the surplus from what is coming from the circulation pump. The main advantage of this alternative embodiment therefore is that the ink flow through the degassing unit may be set independent from the ink flow through the printhead and therefore the degassing unit can be operated at an optimal rate, whatever flow constraints are applicable to the flow rate through the printhead.

In an alternative embodiment serving the same purpose, i.e. optimal degassing conditions, the bypass path is arranged between the exit of the degassing unit 60, i.e. before replenish valve 24, and the ink entry to the return vessel 50, i.e. after drain valve 34. The ink content of return vessel 50 is now also included in the conditioning flow.

Embodiments for Specific Printer Configurations: Multiple Colors

In a color inkjet printer, each color is printed with a different printhead or a set of printheads. Each color has its own ink system with an off-axis part and a carriage part. Each ink system can support one or a multitude of printheads printing the same color. The multitude of printheads printing the same color can be assembled into a module reciprocating across the printing medium and printing swaths that are wider than the width of a single printhead, or they can be staggered into a full page-wide printhead assembly.

Embodiments for Specific Printer Configurations: End-Shooter Type Printhead

Figure 4:
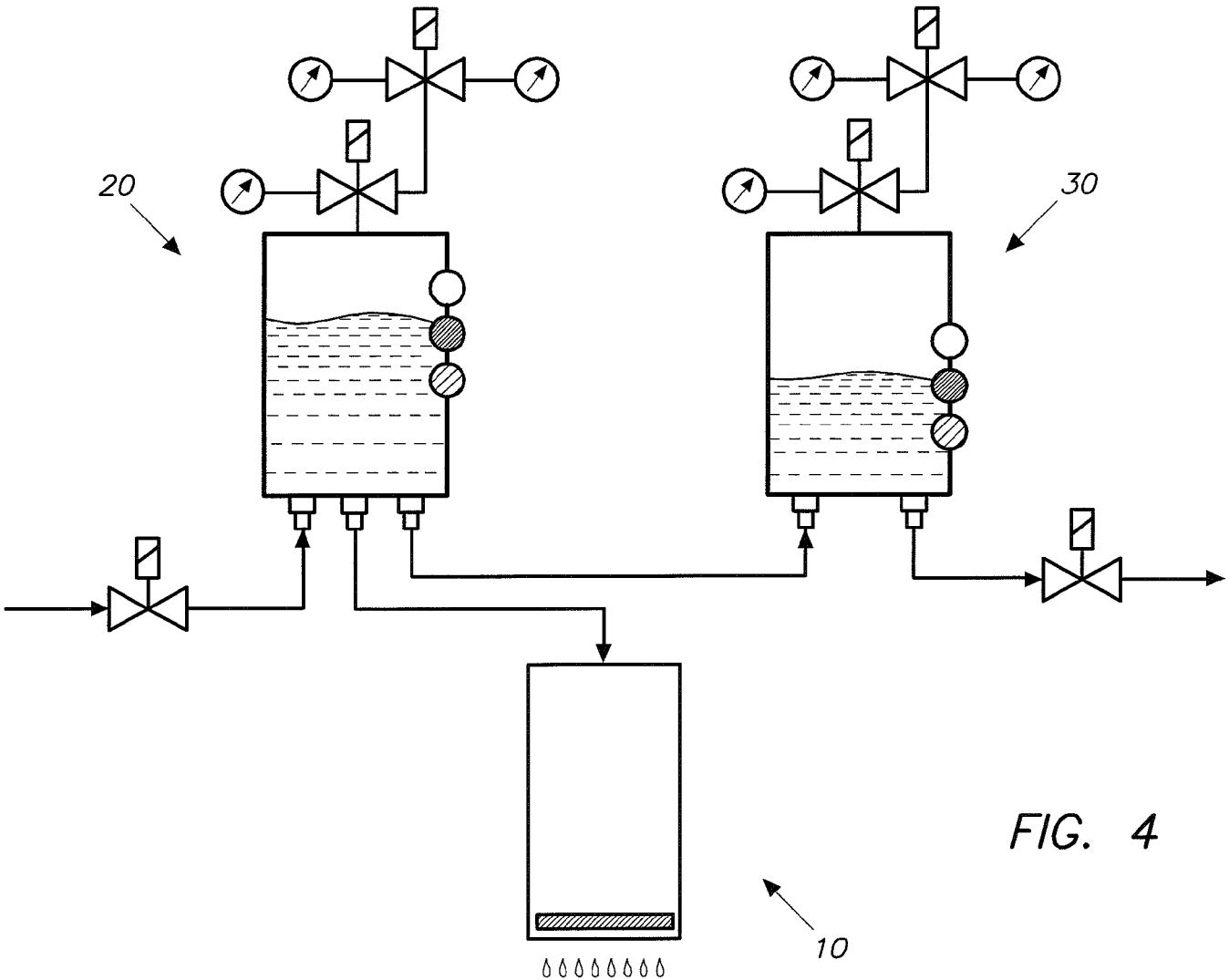
FIG. 4 shows a schematic view of an embodiment of a carriage ink system according to the invention, suitable for connecting an end-shooter type printhead.

So far, the present invention has been described with through-flow type printheads. The advantages of a continuous ink circulation with continuous active degassing are indeed substantial with the use of through-flow type printheads, because the ink in the printhead is continuously rejuvenated with fresh and conditioned ink. Prior art ink systems for end-shooter type printheads with only an ink inlet often have a one-way supply of ink chain from a main ink tank or cartridge to the printhead. These ink systems do not have ink circulation and therefore the ink in the printheads, the tubing and other components can not be continuously rejuvenated. An embodiment of the present invention for end-shooter printhead may be very similar to the embodiment depicted in FIG. 1, except for the fact that the printhead is not connected in series between the supply subtank and the return subtank but in parallel with a shortcut between the supply tank and the return tank. FIG. 4 shows the carriage ink system of an embodiment of the invention for end-shooter type printheads. For end-shooter ink supply systems, the invention may have the following advantages. Firstly, the amount of ink retained in the ink system that is not rejuvenated via circulation is limited to the amount in the end-shooter printhead. Consequently, in the event of nozzle failure or maintenance, the amount of 'waste' ink that needs to be purged through the printhead before fresh ink is available at the nozzles is also reduced. Even more, because degassing properties of ink may degrade over time while residing in the supply tubes and intermediate reservoirs of the ink system, rejuvenation and circulation of the ink limits the amount of 'startup ink waste' that, after for example a week-end production stop, can not be rejuvenated and therefore needs to be purged through the printhead. A second advantage is that a constant and optimal operating point for the inline through-flow degassing unit can be provided resulting in better controlled dissolved gas removal level of the ink. A lot of degassing units are not suited for operation at low flow rates, inherent to one-way ink supply systems for end-shooter printheads, because of their steep degassing characteristic.

Having described in detail preferred embodiments of the current invention, it will now be apparent to those skilled in the art that numerous modifications can be made therein without departing from the scope of the invention as defined in the appending claims.

BRIEF DESCRIPTION OF REFERENCE NUMERALS

1 Ink system
2 Off-axis ink system
3 Carriage ink system
10 Printhead
10*a*, 10*b* Array of nozzles
11 Ink inlet
12 Ink outlet
13, 14 Electric or fluid connections
15 Conditioning means
19 Conditioning circuit
20 Supply subtank
30 Return subtank
40 Supply vessel
50 Return vessel
21, 31, 41, 51, 61 Ink entry
22, 32, 42, 52, 62 Ink exit
23, 33, 43, 53, 63, 93 Pressure connection
24 Replenish valve
34 Drain valve
84 Ink uploading valve
25, 35 Minimum level sensor
26, 36, 46, 56 Operating level sensor
27, 37 Maximum sevel sensor
28 Free ink surface
29, 39, 49, 59 Closed container
48, 58 Fresh ink inlet
70 Main ink tank
71, 74 Check valve
72, 75, 65 Filter
73,76 Pump
78 Flow restriction
60 Active through-flow degassing unit
64 Vacuum break valve
66 Vacuum control valve
80 Ink cartridge
90 Printhead subtank
91 Overflow wall

The invention claimed is:

1. An ink circulation system for use in a drop on demand inkjet printing apparatus, the ink circulation system comprising:

an inkjet printhead arranged to eject ink drops therefrom;

a supply path arranged to supply an ink to the inkjet printhead and a return path arranged to return a surplus of the ink, that is not used to eject ink drops from the inkjet printhead;

a refresh path arranged to couple the return path with the supply path to refresh the supply path with the surplus of the ink returned by the return path; and an active through-flow ink degassing unit arranged to control a dissolved gas level of the ink, the active through-flow ink degassing unit including an ink entry arranged to receive a flow of ink and an ink exit arranged to deliver a flow of degassed ink; wherein the active through-flow degassing unit further includes a vacuum connection arranged to apply a vacuum, and a semi-permeable membrane arranged to provide a surface area where the ink and the vacuum come into direct contact with each other without the ink penetrating the semi-permeable membrane.

2. The ink circulation system according to claim 1, further comprising a valve arranged to control the vacuum applied to the active through-flow degassing unit.

3. The ink circulation system according to claim 1, wherein the semi-permeable membrane is a hollow fiber type membrane.

4. The ink circulation system according to claim 1, wherein the active through-flow degassing unit is arranged to control the dissolved gas level of the ink between a minimum level of dissolved gas in the ink and a maximum level of dissolved gas in the ink.

5. The ink circulation system according to claim 4, wherein the active through-flow degassing unit is arranged to control the dissolved gas level of the ink between the minimum level and the maximum level depending on a type of the ink in the ink circulation system.

6. The ink circulation system according to claim 1, wherein the refresh path includes a circulation pump, and the active through-flow degassing unit is provided in the refresh path.

7. The ink circulation system according to claim 1, further comprising a bypass path parallel with the refresh path and arranged to allow an amount of ink from the refresh path to bypass the supply path, the inkjet printhead and the return path.

8. An inkjet printing apparatus comprising:

the ink circulation system according to the claim 1.

9. A method of providing a flow of ink to a drop on demand inkjet printhead in a printing mode, the method comprising the steps of:

supplying a print ink flow to the inkjet printhead via an ink supply path and receiving a surplus of the print ink flow, that is not used for printing, from the inkjet printhead via an ink return path;

feeding the surplus of the print ink flow received from the ink return path back to the ink supply path via a refresh path; and controlling a dissolved gas level of the print ink flow supplied to the inkjet printhead by bringing a vacuum in contact with the print ink flow via a semi-permeable membrane.

10. The method according to claim 9, further comprising the step of:

controlling the vacuum with a valve.

11. The method according to claim 9, further comprising the step of:

controlling the dissolved gas level of the ink between a minimum level of dissolved gas in the ink and a maximum level of dissolved gas in the ink.

12. The method according to claim 11, further comprising the step of:

controlling the dissolved gas level of the ink between a minimum level of dissolved gas in the ink and a maximum level of dissolved gas in the ink depending on a type of the ink in the print ink flow.

13. The method according to claim 9, further comprising the steps of:

providing a bypass path parallel with the refresh path to allow an amount of the print ink flow through the refresh path to bypass the supply path, the inkjet printhead, and the return path;

circulating an amount of the print ink flow through the refresh path through the bypass path; and controlling the dissolved gas level of a total of the print ink flow through the bypass path and the print ink flow through the supply path, the printhead, and the return path.

* * * * *